US007077502B2

(12) United States Patent
Mitsuzawa

(10) Patent No.: US 7,077,502 B2
(45) Date of Patent: Jul. 18, 2006

(54) PRINTING WITH MULTIPLE PRINT HEADS

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 44 days.

(21) Appl. No.: 10/439,289

(22) Filed: May 16, 2003

(65) Prior Publication Data

US 2004/0104965 A1 Jun. 3, 2004

(30) Foreign Application Priority Data

May 24, 2002 (JP) ..... 2002-151404

(51) Int. Cl.
*B41J 2/21* (2006.01)
*B41J 29/38* (2006.01)

(52) U.S. Cl. ..... 347/43; 347/17
(58) Field of Classification Search ..... 347/17, 347/12, 40, 43, 15
See application file for complete search history.

(56) References Cited

U.S. PATENT DOCUMENTS 6,095,637 A * 8/2000 Hirabayashi et al. ..... 347/43
6,827,424 B1 * 12/2004 Teshigawara et al. ..... 347/43

FOREIGN PATENT DOCUMENTS

JP 7-256895 A 10/1995
JP 8-132620 A 5/1996
JP 2001-260330 A 9/2001

* cited by examiner

*Primary Examiner*—Lamson Nguyen
(74) *Attorney, Agent, or Firm*—Sughrue Mion, PLLC

(57) ABSTRACT

Controlling ejection of ink drops with a less number of temperature sensors than the number of print heads.

The present invention is an printing apparatus for printing by ejecting ink drops onto a print medium. The printing apparatus comprises N print heads, M temperature sensors, and an ejection controller. M temperature sensors are allocated in the printing apparatus. An ejection controller is configured to control the ejection of he ink drops from at least part of the N print heads in response to an output of the M temperature sensors. The integer M is smaller than the integer N.

4 Claims, 11 Drawing Sheets

Three original drive waveforms available for drive of print head 28a

Relation between the temperatures at print head 28a and ink ejection amounts

The second embodiment

Relations between the driving voltages of print heads 28a and 28e and ink ejection speeds Assumed combinations of the temperatures of print heads 28a and 28e

| | | | |
|---|---|---|---|
| Print head 28a | t1, t2, t3 | t2, t3 | t3 |
| Print head 28e | t1 | t2 | t3 |

Relations between the driving voltages of print heads 28a and 28e and ink ejection speeds Assumed combinations of the temperatures of print heads 28a and 28e

| | | | |
|---|---|---|---|
| Print head 28a | t1 | t2 | t3 |
| Print head 28e | t1, t2, t3 | t2, t3 | t3 |

Relations between the driving voltages of print heads 28a and 28e and ink ejection speeds

PRINTING WITH MULTIPLE PRINT HEADS

BACKGROUND OF THE INVENTION

1. Field of the Invention

The present invention relates to a printing technique for forming dots on a printing medium with multiple print heads.

2. Description of the Related Art

Color printers that make several color inks ejected from a print head to form ink dots on a printing medium have become widely used. High-speed printing apparatuses with multiple print heads have also been proposed. One proposed technique for the improved printing quality equips a temperature sensor to each print head to reduce variations in size and ejecting position of ink drops, due to a temperature variation among the print heads.

The increase in number of print heads used for printing causes an increase in number of working temperature sensors. The temperature may, however, not be varied among all the print heads, but some print heads may have a substantially similar temperature.

SUMMARY OF THE INVENTION

The object of the present invention is thus to solve the drawback of the prior art technique and to provide a technique of controlling ejection of ink drops with a less number of temperature sensors than the number of print heads.

In order to attain the above and the other objects of the present invention, there is provided an printing apparatus for printing by ejecting ink drops onto a print medium. The printing apparatus comprises N print heads, M temperature sensors, and an ejection controller. The N print heads have a nozzle array including a plurality of nozzles for ejecting at least one color of same ink. N is an integer of at least two. The M temperature sensors are allocated in the printing apparatus. M is an integer of at least one. The ejection controller configured to control the ejection of the ink drops from at least part of the N print heads in response to an output of the M temperature sensors. The integer M is smaller than the integer N.

The printing apparatus of the present invention uses the less number of temperature sensors than the number of print heads to control ejection of ink drops in response to the temperature variation among the print heads. This arrangement implements the control by the simpler structure than the prior art structure where a temperature sensor is attached to each print head.

In one preferable arrangement of the printing apparatus, the ejection controller is configured to control the ejection of the ink drops in order to compensate for a variation in ejection of the ink drops due to a temperature variation of the N print heads.

This arrangement desirably compensates for the variation in ejection of ink drops due to the temperature variation among the print heads. The variation in ejection of ink drops due to the temperature variation among the print heads is, for example, a variation in size of ink drops or a variation in ejecting position of ink drops.

In another preferable arrangement of the printing apparatus, the ejection controller is configured to stop the ejection of ink drops from the N print heads, when output of at least part of the M temperature sensors exceed a specific value representing a preset temperature.

This arrangement effectively prevents any significant deterioration of the printing quality due to the temperature variation among the print heads, and desirably protects the printing apparatus from the severe hot environment.

In one preferable embodiment of the printing apparatus, the nozzle array has a plurality of ejection drive elements for ejecting ink drops from the plurality of nozzles. The ejection controller comprises: an original drive signal generator configured to generate an original drive signal for driving the ejection drive elements; and an original drive waveform generator configured to generate an original drive waveform which is a waveform of the original drive signal. The original drive waveform generator determines the original drive waveform to be supplied to at least part of the N print heads, in response to the output of the M temperature sensors.

This arrangement generates a driving signal according to the properties of each print head, thus attaining fine control.

In one preferable application, the printing apparatus has a plurality of print modes of different printing resolutions and is capable of selecting one of the plurality of print modes for printing. The ejection controller controls the ejection of ink drops from at least part of the N print heads in response to the output of the M temperature sensors and the selected print mode.

This arrangement controls ejection of ink drops from the multiple print heads according to the output of the temperature sensors and the selected print mode, instead of the output of the temperature sensors alone, thus ensuring optimum adjustment for each printing resolution.

In one preferable arrangement of the printing apparatus, the N print heads are located at a plurality of positions of different elevations in an operation of the printing apparatus. The temperature sensor is disposed on at least one of the plurality of positions of different elevations.

When the multiple print heads are located at the multiple positions of different elevations in the working state of the printing apparatus, a heat pool may be present at a high position to increase the temperature variation among the print heads. The technique of the invention accordingly has significant effects on this structure.

In the case where the printing apparatus has only one temperature sensor, it is preferable that the temperature sensor is disposed at a highest position among the plurality of positions of different elevations.

In another preferable arrangement of the printing apparatus, the N print heads are located at a plurality of positions of different elevations in an operation of the printing apparatus. A print head having a relatively high ink ejection speed in the case of ejecting an ink drop of a same weight at a same temperature is located at a relatively high position.

This arrangement enhances the hitting accuracy of the ink drop, simultaneously with compensation for the quantity of ink ejection.

In another preferable embodiment of the printing apparatus, each print head has three nozzle arrays for ejecting at least three inks of cyan, magenta, and yellow. The three nozzle arrays are restricted such that variations in driving voltages for ejecting an ink drop of a same weight at a same temperature within a preset allowable range.

A second application of the present invention is directed to a printing apparatus for printing by ejecting ink drops onto a print medium. The printing apparatus comprises a plurality of print heads, a plurality of temperature sensors, and an ejection controller. The plurality of print heads have a nozzle array including a plurality of nozzles for ejecting at least one color of same ink. The plurality of temperature sensors are allocated in the printing apparatus. The ejection controller are configured to control the ejection of the ink drops from at least part of the plurality of print heads in response to an output of the plurality of temperature sensors in order to compensate for a variation in ejection of the ink drops due to a temperature variation of the plurality of print heads. The plurality of print heads are located at a plurality of positions of different elevations in an operation of the printing apparatus. The print head have a relatively high ink ejection speed in the case of ejecting an ink drop of a same weight at a same temperature is located at a relatively high position.

In the printing apparatus of this application, it is preferable that the print head having a relatively high driving voltage for ejecting an ink drop of a fixed weight at a fixed temperature is regarded as the print head having a relatively high ejection speed of the ink drop and is located at the relatively high position.

This arrangement allows for easy application of the invention without measuring the ink ejection speed.

The printing apparatus may have a cleaning unit that carries out cleaning of the multiple nozzles with regard to each print head. In this configuration, the cleaning unit is preferably designed to specify a cleaning process of each print head according to the output of the temperature sensor.

A third application of the present invention is directed to a printing apparatus for printing by ejecting ink drops onto a print medium. The printing apparatus comprises N print heads and M temperature sensors. N print heads have a nozzle array including a plurality of nozzles for ejecting at least one color of same ink. N is an integer of at least two. M temperature sensors are allocated in the printing apparatus. M is an integer of at least one. The integer M is smaller than the integer N. The printing apparatus is configured to stop the ejection of ink drops from the N print heads, when output of at least part of the M temperature sensors exceeds a specific value representing a preset temperature.

This arrangement effectively prevents any significant deterioration of the printing quality due to the temperature variation among the print heads, and desirably protects the printing apparatus from the severe hot environment.

The printing apparatus may be arranged to stop the printing when at least a preset number of temperature sensors have the output exceeding the specific value.

The technique of the inventions may be actualized by a variety of other applications, for example, a printing method.

DESCRIPTION OF THE PREFERRED EMBODIMENTS

The present invention is explained in the following sequence based on embodiments.

A. Outline of Apparatus

B. First Embodiment of the Invention

C. Second Embodiment of the Invention

D. Modifications

A. Outline of Apparatus

Figure 1:
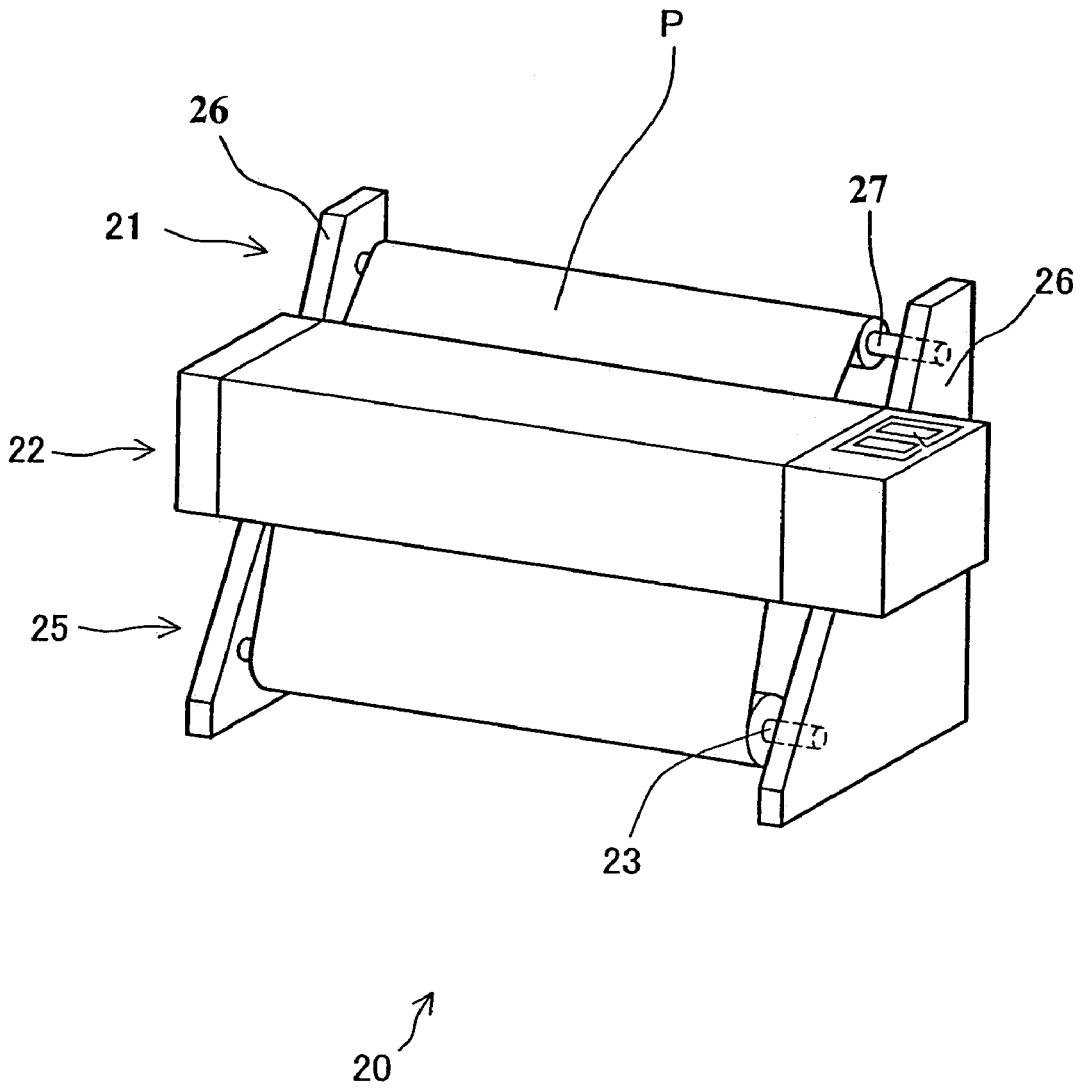
FIG. 1 is a perspective view schematically illustrating the structure of a color printer 20 in one embodiment of the present invention.

FIG. 1 is a perspective view schematically illustrating the structure of a color printer 20 in one embodiment of the present invention. The color printer 20 is suitably used for relatively large-sized printing paper P, such as size A0 or B0 paper in conformity with the JIS standards (Japanese Industrial Standards) or roll paper. The printing paper P is fed from a paper feed unit 21 to a printing unit 22. The printing unit 22 ejects ink for printing on the fed printing paper P and delivers the printing paper P with the print to a paper delivery unit 25.

The paper feed unit 21 has a roll paper holder 27 on which roll paper as the printing paper P is settable. The roll paper holder 27 is held by two support columns 26 of the color printer 20. The paper delivery unit 25 has a windup holder 23, on which the roll paper is windable. Like the roll paper holder 27, the windup holder 23 is held by the two support columns 26 and is rotatable by a non-illustrated drive unit.

Figure 2:
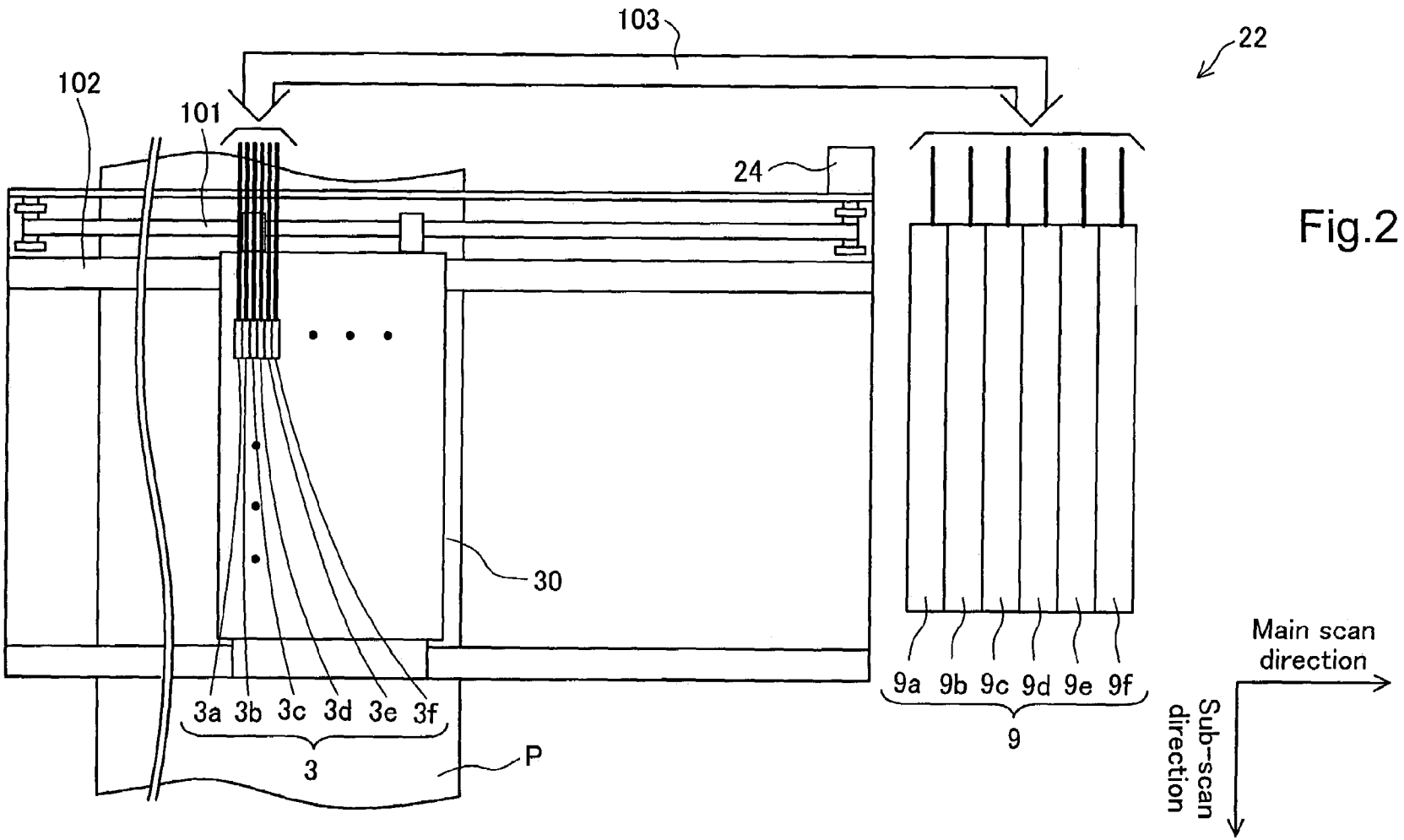
FIG. 2 is an explanatory view illustrating the structure of a printing unit 22.

FIG. 2 is an explanatory view illustrating the structure of the printing unit 22. The printing unit 22 has a carriage 30, on which multiple print heads discussed later are mounted. The carriage 30 is linked with a drive belt 101 actuated by a carriage motor 24, and is guided by a main scan guide member 102 to be movable in a main scan direction.

In the color printer 20 having the hardware construction discussed above, while the paper P is fed via the windup holder 23, the carriage 30 is reciprocated by the carriage motor 24. Simultaneously, ejection drive elements of print heads, which will be discussed later, are actuated to eject ink drops of the respective color inks and form ink dots, thus forming a multi-color, multi-tone image on the printing paper P.

B. First Embodiment of the Invention

Figure 3:
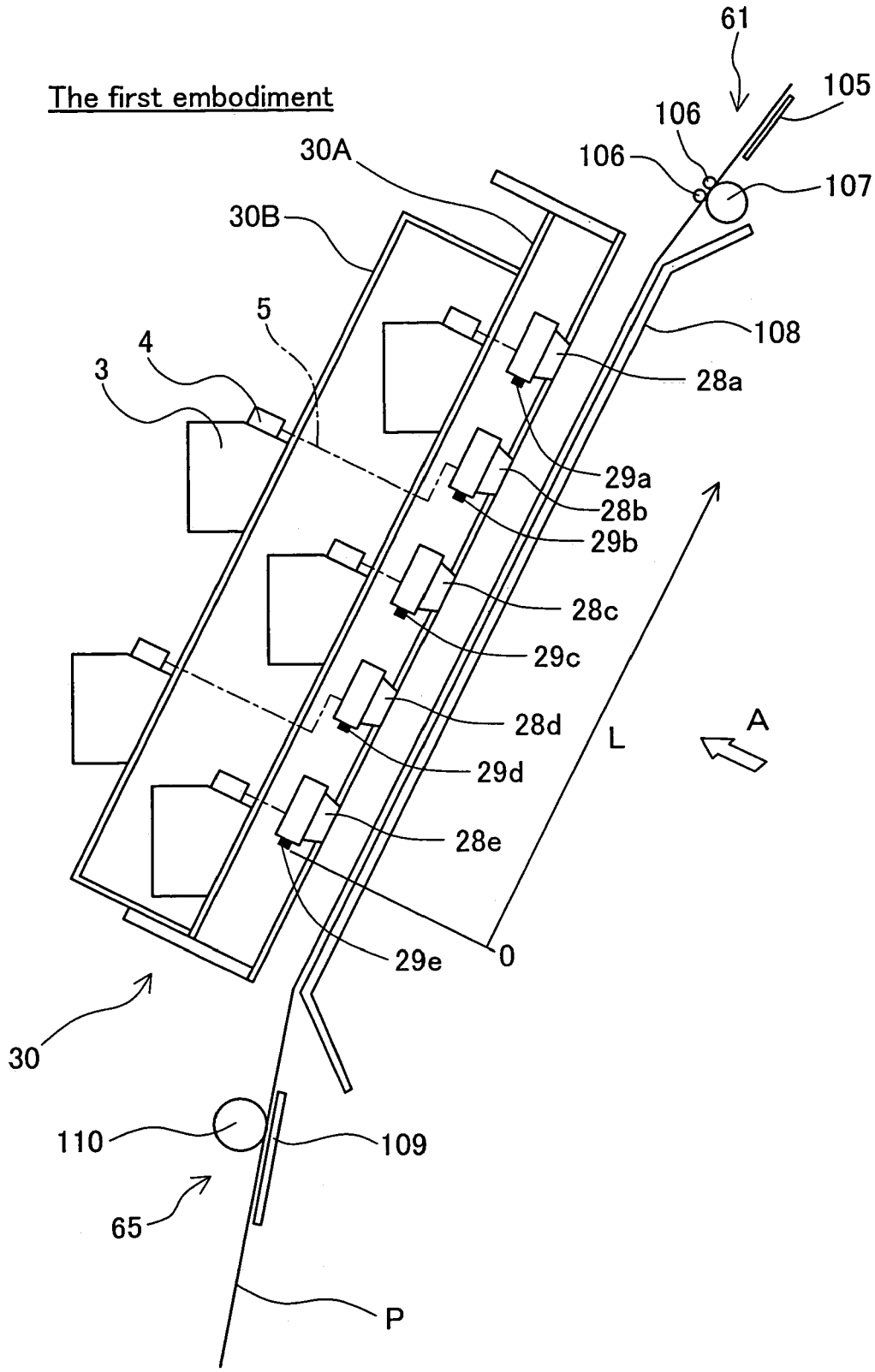
FIG. 3 is a partial sectional view illustrating the printing unit 22 including a carriage 30.

FIG. 3 is a partial sectional view illustrating the printing unit 22 including the carriage 30 in the first embodiment of the present invention. The printing paper P fed from the paper feed unit 21 (FIG. 1) is subjected to printing on a printing stage 108, which is located between a paper feed guide assembly 61 and a paper delivery guide assembly 65, and is wound up onto the windup holder 23. The printing stage 108 is arranged in an inclined manner to face the carriage 30.

The paper feed guide assembly 61 has a paper feed guide 105 that guides the printing paper P toward the printing stage 108, on which ink ejection is carried out, and two paper feed rollers 106 and a driven roller 107 to hold the printing paper P between them. The paper delivery guide assembly 65 has a paper delivery guide 109 that guides the printing paper P away from the printing stage 108 and a paper delivery roller 110.

The carriage 30 has two-stepped sub tank plates 30A and 30B. Multiple sub tanks 3 are mounted on each of the sub tank plates 30A and 30B. Each of the sub tanks 3 is connected to an ink supply conduit 5 via a valve 4. The ink supply conduit 5 is connected with each of multiple print heads 28*a*, 28*b*, . . . , 28*t*. An ink supply path 103 (FIG. 2) connects each sub tank 3 with a main tank 9. The main tank 9 stores six different color inks, black K, cyan C, light cyan LC, magenta M, light magenta LM, and yellow Y ejected from the multiple print heads 28*a*, 28*b*, . . . 28*t*. Temperatures sensors 29*a*, 29*b*, . . . 29*e* are discussed later.

Figure 4:
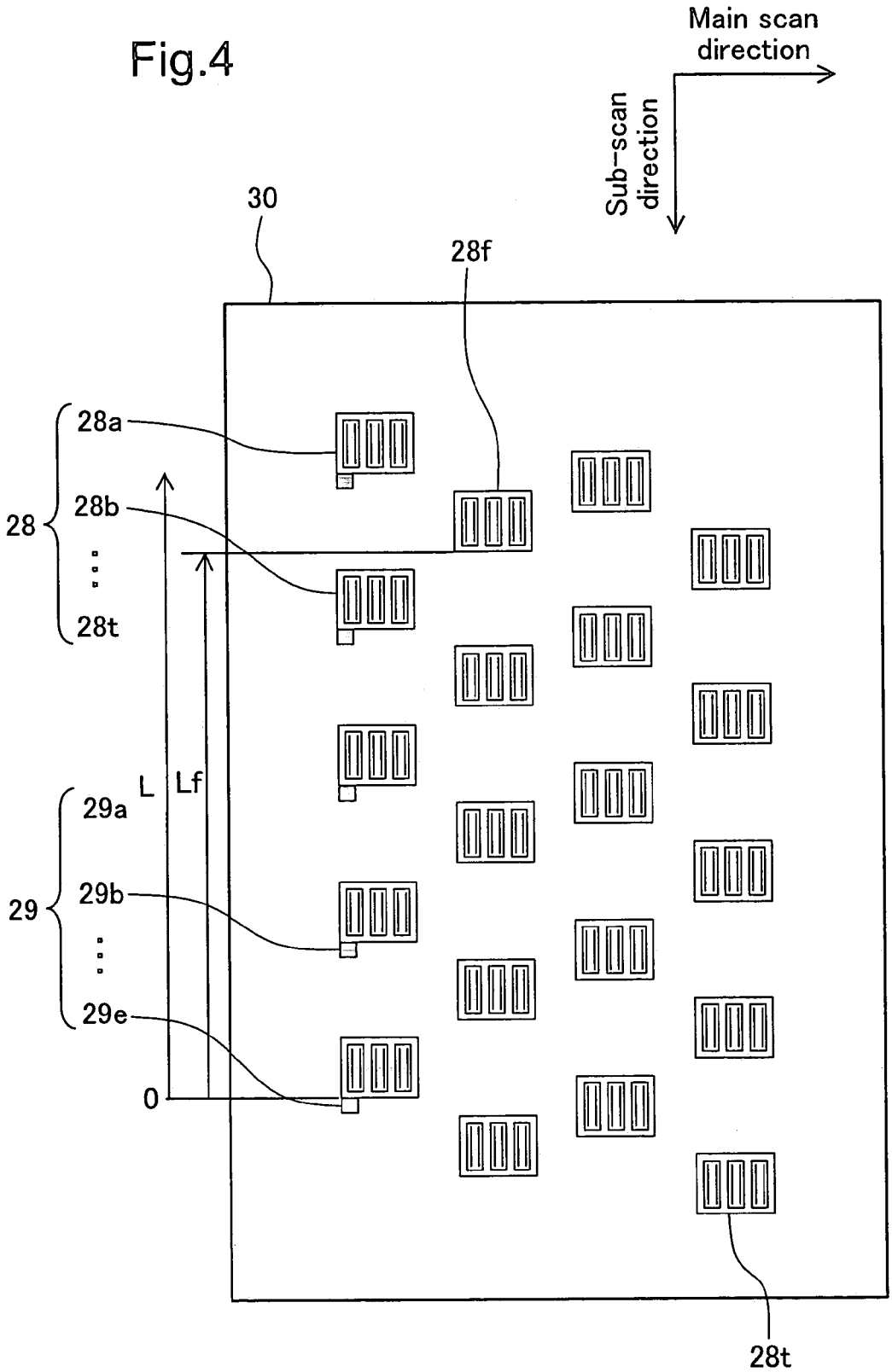
FIG. 4 is an explanatory view schematically showing the carriage 30.

FIG. 4 is a view showing the carriage 30 in a direction of an arrow A (FIG. 3). The carriage 30 includes a print head assembly 28 consisting of the multiple print heads 28*a*, 28*b*, . . . 28*t*. The temperature sensors 29*a*, 29*b*, . . . , 29*e* are attached respectively to the print heads 28*a*, 28*b*, . . . , 28*e* in the print head assembly 28.

Attachment of the temperature sensors 29*a*, 29*b*, . . . , 29*e* to only the print heads 28*a*, 28*b*, . . . , 28*e* aligned in a sub-scan direction is ascribed to the expectation that there is a significant temperature variation in the sub-scan direction but there is a negligibly small temperature variation in a main scan direction. A significant temperature variation in the sub-scan direction is expected, since the air warmed by the working print heads tends to flow up to make the temperature of the print head 28*a* higher than the temperature of the print head 28*e*. A small temperature variation in the main scan direction is expected, on the other hand, since the carriage 30 continually moves back and forth in the main scan direction at a high speed in the course of printing. The expression 'negligibly small temperature variation' means that the temperature variation is of the small level and hardly affects the quantity of ink ejection.

Figure 5:
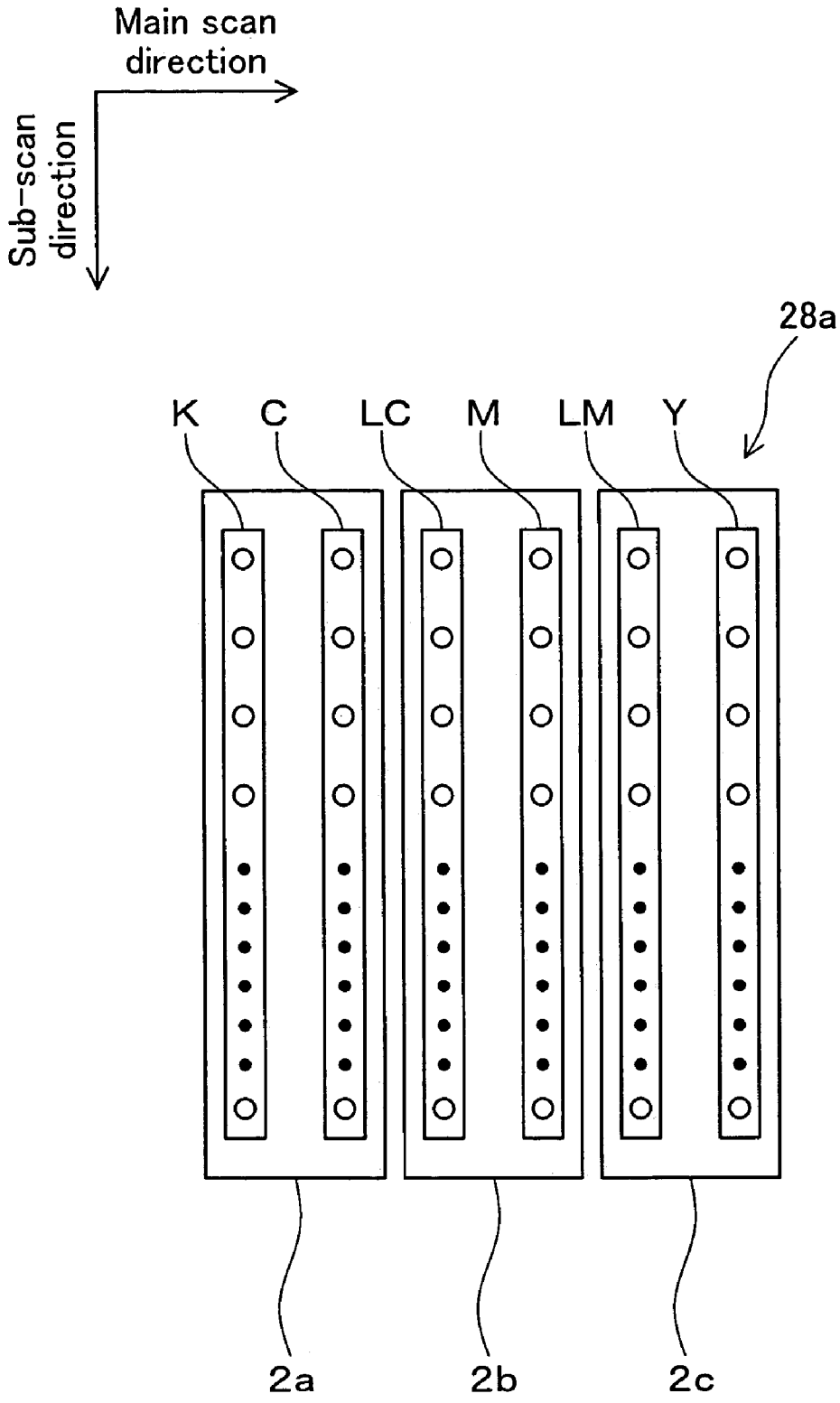
FIG. 5 is an explanatory view showing a bottom face of a print head 28*a;*

FIG. 5 is an explanatory view showing a bottom face of the print head 28*a*. The print head 28*a* has three nozzle plates 2*a*, 2*b*, and 2*c*. Two nozzle arrays, which are capable of ejecting different inks, are provided on the lower face of each nozzle plate. The print head 28*a* thus totally has six nozzle arrays. The six color inks, black (K), cyan (C), light cyan (LC), magenta (M), light magenta (LM), and yellow (Y), are ejected respectively from the nozzles on the six nozzle arrays. All the print heads 28*a*, 28*b*, . . . , 28*t* have an identical structure.

Each nozzle has a piezoelectric element(discussed later) as an ejection drive element to make ink drops ejected from each nozzle. In the course of printing, ink drops are ejected from the respective nozzles, while the print head assembly 28 moves in the main scan direction.

Figure 6:
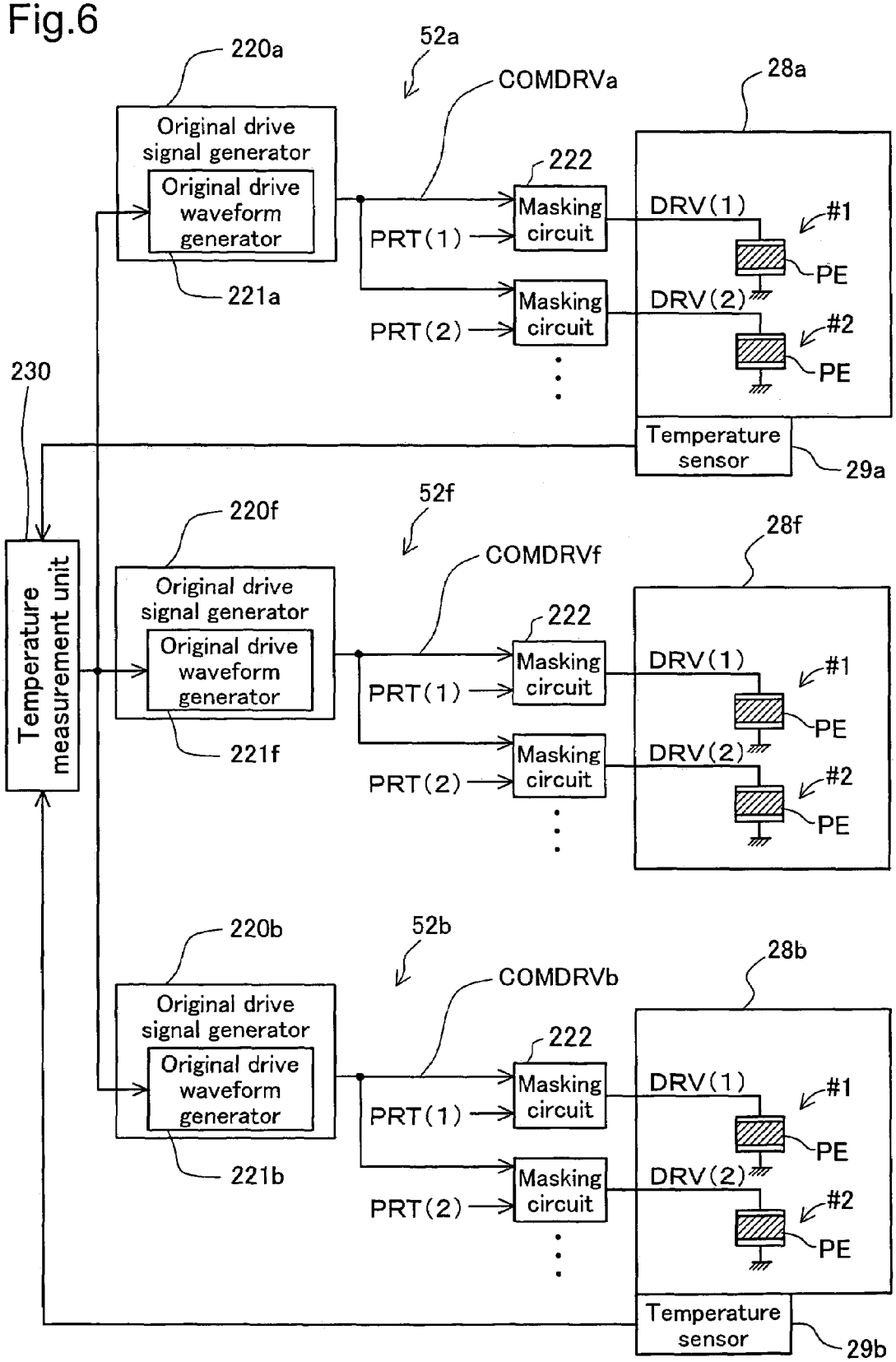
FIG. 6 is an explanatory view showing the primary structure of head driving circuits 52*a*, 52*b*, and 52*f* in the first embodiment of the invention.

FIG. 6 is an explanatory view showing the primary structure of head driving circuits 52*a*, 52*b*, and 52*f* in the first embodiment of the invention. The head driving circuits 52*a*, 52*b*, and 52*f* drive piezoelectric elements PE included in the corresponding print heads 28*a*, 28*b*, and 28*f* for ink ejection. A temperature measurement unit 230 is connected to the head driving circuits 52*a*, 52*b*, and 52*f*. This explanatory view shows only part of a group of head driving circuits 52*a*, 52*b*, . . . , 52*t* that respectively drive the print heads 28*a*, 28*b*, 28*t*.

The head driving circuit 52*a* includes an original drive signal generator 220*a* and plural mask circuits 222. The original drive signal generator 220*a* generates an original drive signal COMDRVa, which is shared by multiple nozzles included in the print head 28*a*, and supplies the generated original drive signal COMDRVa to the plural mask circuits 222. The original drive signal COMDRVa functions to drive the piezoelectric elements PE for ink ejection. The plural mask circuits 222 are provided corresponding to respective nozzles #1, #2, . . . , on the print head 28*a*. Similarly, each of the other head driving circuits 52*b* and 52*f* includes an original drive signal generator 220*b* or 220*f* and plural mask circuits 222.

For example, actuation of an i-th nozzle on the print head 28*a* is controlled in response to a print signal PRT(i) in the following manner. An i-th mask circuit 222 provided corresponding to the i-th nozzle controls on/off the original drive signal COMDRVa according to the level of the serial print signal PRT(i) for the i-th nozzle. The mask circuit 222 allows passage of the original drive signal COMDRVa at a level '1' of the print signal PRT(i); while blocking passage of the original drive signal COMDRVa at a level '0' of the print signal PRT(i).

Figure 7A:
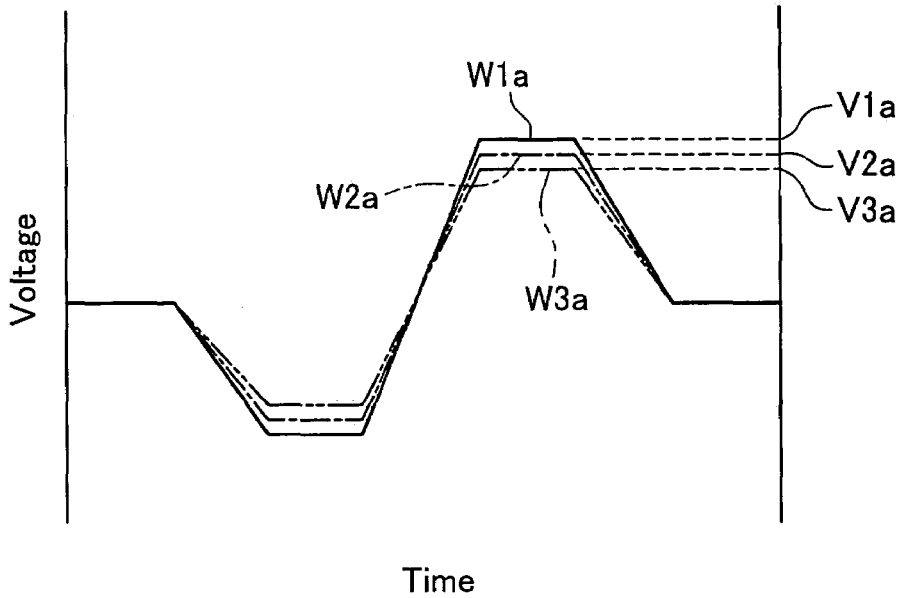
FIGS. 7A and 7B are explanatory views showing original drive waveforms W1*a*, W2*a*, and W3*a* generable by an original drive signal generator 220*a;*
Figure 7B:
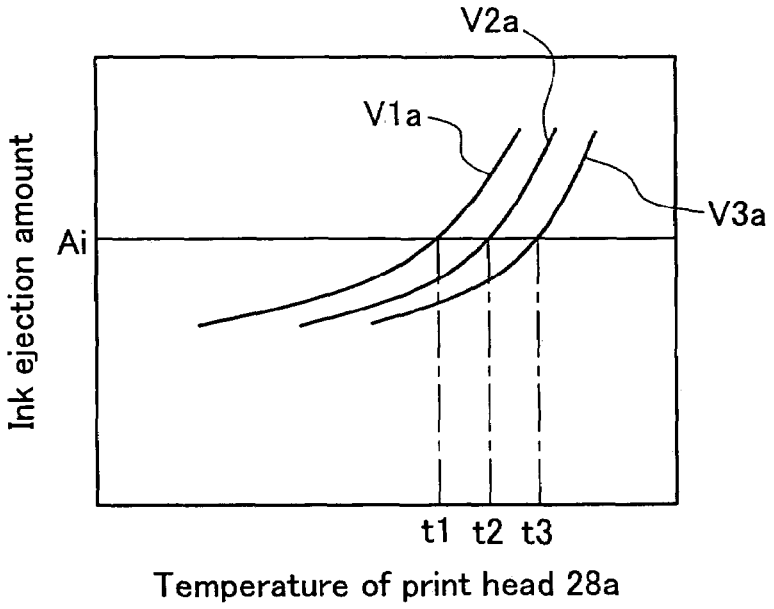

FIGS. 7A and 7B are explanatory views showing multiple original drive waveforms generable by the original drive signal generator 220*a*. FIG. 7A is an explanatory view showing original drive waveforms W1*a*, W2*a*, and W3*a* generated by the original drive signal generator 220*a* to be available for the drive of the print head 28*a*. The original drive signal COMDRVa is generated by successively outputting selected waveforms among the original drive waveforms W1*a*, W2*a*, and W3*a*. The original drive waveforms W1*a*, W2*a*, and W3*a* have mutually different amplitudes (voltages). Voltages V1*a*, V2*a*, and V3*a* are set respectively to peak voltages of the original drive waveforms W1*a*, W2*a*, and W3*a*.

FIG. 7B is an explanatory view showing a method of setting the peak voltages, V1*a*, V2*a*, and V3*a*. The peak voltages V1*a*, V2*a*, and V3*a* are set according to the characteristics of the print head 28*a*, to which the original drive signal COMDRVa is supplied. The procedure determines the settings to make the quantities of ink ejection from the print head 28*a* substantially equal to a preset reference value Ai at three reference temperatures t1, t2, and t3. For example, at the reference temperature t1, the peak voltage V1*a* is set to make the quantity of ink ejection substantially equal to the preset reference value Ai. Similarly the peak voltages V2*a* and V3*a* are set at the reference temperatures t1 and t2, respectively. The three reference temperatures t1, t2, and t3 are commonly used as criteria for all the print heads in the print head assembly 28.

These settings generate a resulting driving signal DRV, such that the quantity of ink ejection by actuation of the print head 28*a* with the original drive waveform W1*a* is substantially equal to the quantity of ink ejection by actuation of the print head 28*b* with an original drive waveform W1*b* (that is, the reference value Ai), for example, at the reference temperature t1.

Figure 8:
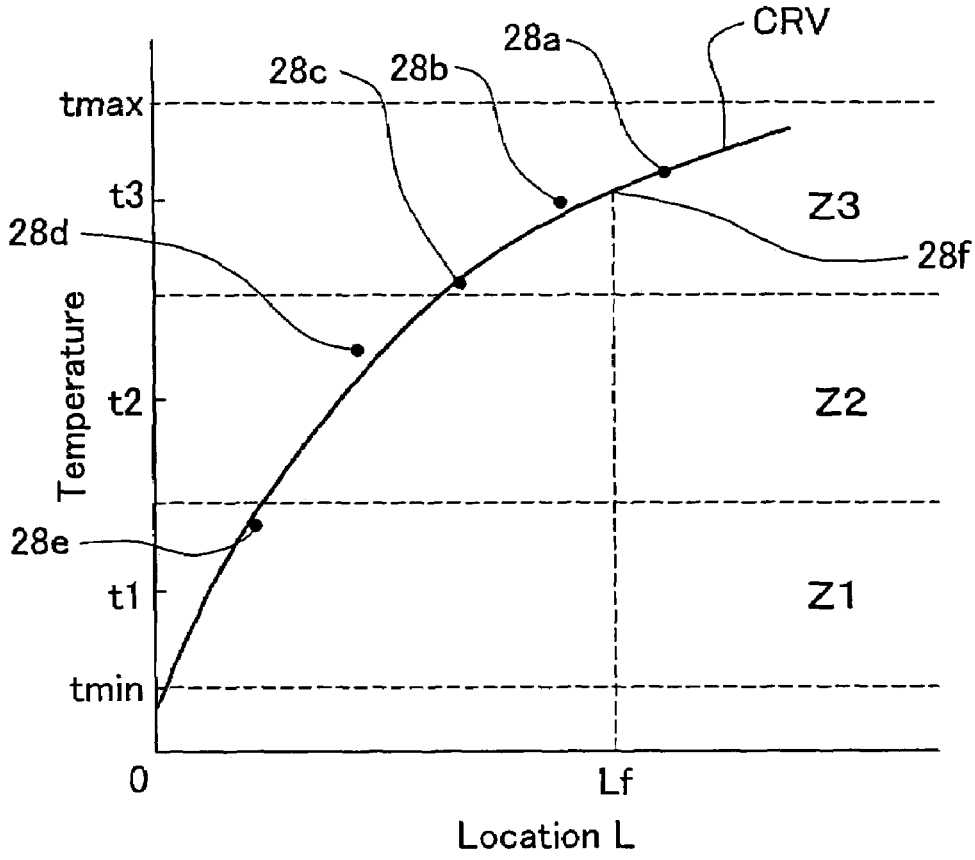
FIG. 8 is an explanatory view showing the relation between the location in a print head assembly 28 and the temperature.

FIG. 8 is an explanatory view showing the relation between the location in the print head assembly 28 and the temperature. The abscissa of this graph shows a location L in the print head assembly 28 on the carriage 30 (see FIGS. 3 and 4). For the simplicity of illustration, the print heads 28*g* to 28*t* are omitted.

Observed temperatures of the respective print heads 28*a* to 28*f* are plotted on the ordinate of FIG. 8. A maximum temperature tmax represents an expected highest operation temperature of the respective print heads 28*a* to 28*f* in the color printer 20. A minimum temperature tmin represents an expected lowest operation temperature of the respective print heads 28*a* to 28*f* in the color printer 20. It is expected that the color printer 20 is used for printing in a working temperature range between the minimum temperature tmin and the maximum temperature tmax.

The working temperature range is divided into three temperature zones Z1, Z2, and Z3. The temperature zones Z1, Z2, and Z3 are set as criteria for selection of the original drive waveforms. For example, in the case of the print head 28*a*, the three temperature zones Z1, Z2, and Z3 respectively correspond to the original drive waveforms W1*a*, W2*a*, and W3*a*. In the illustrated example, the observed temperature of the print head 28*a* is included in the temperature zone Z3, so that the, original drive waveform W3*a* is selected among the original drive waveforms W1*a*, W2*a*, and W3*a*.

The details of this selection process are discussed. The temperature sensor 29*a* (FIG. 6) attached to the print head 28*a* generates an electric signal according to the temperature of the print head 28*a* and outputs the electric signal to the temperature measurement unit 230. The temperature measurement unit 230 actually measures the temperature of the print head 28*a* in response to this electric signal and inputs the observed temperature into an original drive waveform generator 221*a*. The original drive waveform generator 221*a* specifies one of the temperature zones Z1, Z2, and Z3, in which the input observed temperature is included, and selects a corresponding original drive waveform among the original drive waveforms W1*a*, W2*a*, and W3*a*.

The original drive signal is selected for the print head 28*f* without the temperature sensor according to the following procedure. The temperature measurement unit 230 creates an approximate curve CRV according to the outputs of the respective temperature sensors 29*a* to 29*e* (FIG. 6) attached to the print heads 28*a* to 28*e*. The temperature of the print head 28*f* is estimated from the approximate curve CRV and a location Lf of the print head 28*f* on the carriage 30. An original drive waveform generator 221*f* specifies one of the temperature zones Z1, Z2, and Z3, in which the estimated temperature input from the temperature measurement unit 230 is included, and selects a corresponding original drive waveform among original drive waveforms W1*f*, W2*f*, and W3*f* (not shown). In the illustrated example, the original drive waveform W3*f* is selected.

The arrangement of this embodiment estimates the temperature of each print head without the temperature sensor and thereby enables the less number of temperature sensors than the number of print heads to effectively compensate for a variation in ejection of ink drops, due to a temperature variation. The temperature measurement unit 230, the group of original drive signal generators 220, and the plural mask circuits 222 function as the 'ejection controller' of the claims.

C. Second Embodiment of the Invention

FIGS. 9 through 11B are explanatory views showing a method of preventing a variation of the ink ejection speed in the print head assembly 28 in a second embodiment of the invention. This method adequately selects the locations of the respective print heads 28*a* through 28*t* on the carriage 30 to prevent the variation of the ink ejection speed. The variation of the ink ejection speed in the print head assembly 28 is ascribed to the different properties of the respective print heads included in the print head assembly 28.

Figure 9:
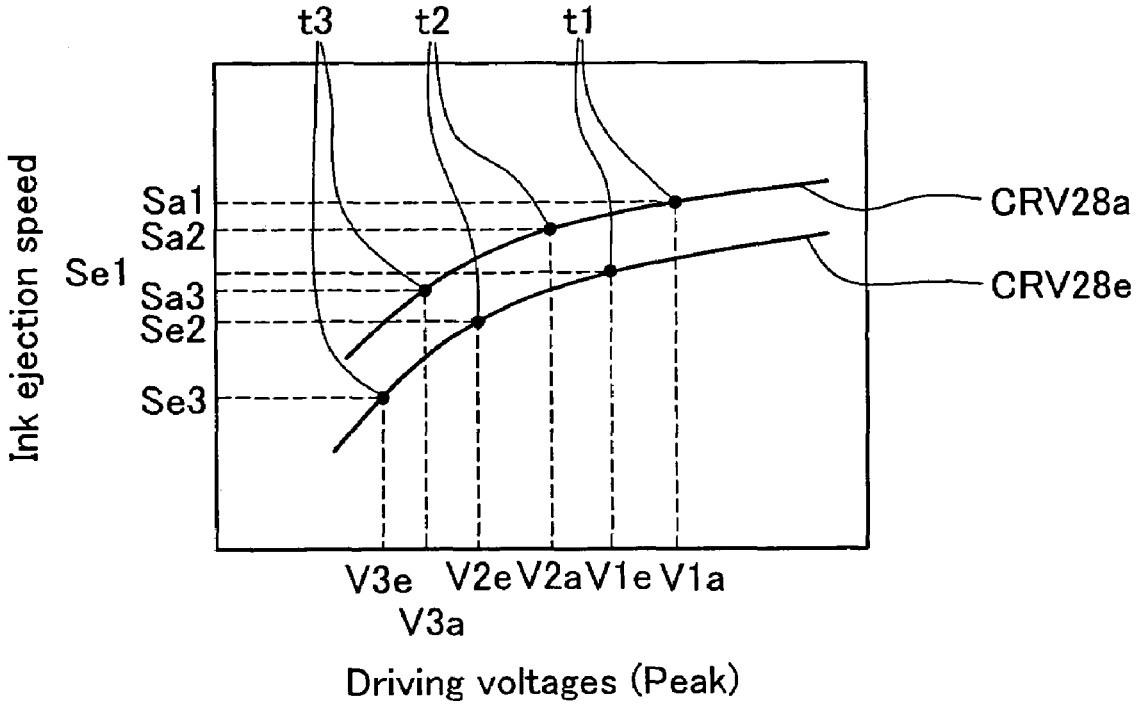
FIG. 9 is an explanatory view showing two curves CRV28*a* and CRV28*e* respectively representing the relations between the driving voltages of print heads 28*a* and 28*e* and the ink ejection speed.

FIG. 9 is an explanatory view showing two curves CRV28*a* and CRV28*e* respectively representing the relations between the driving voltages of the print heads 28*a* and 28*e* and the ink ejection speed. The two curves CRV28*a* and CRV28*e* are created by making ink drops ejected from the respective print heads 28*a* and 28*e* and joining the plots of the observed ejection speeds of the ink drops. In the case of the print head 28*a*, for example, the original drive waveforms W1*a*, W2*a*, and W3*a* are used for ejection of ink drops at the respective reference temperatures t1, t2, and t3.

Figures 10A, 10B:
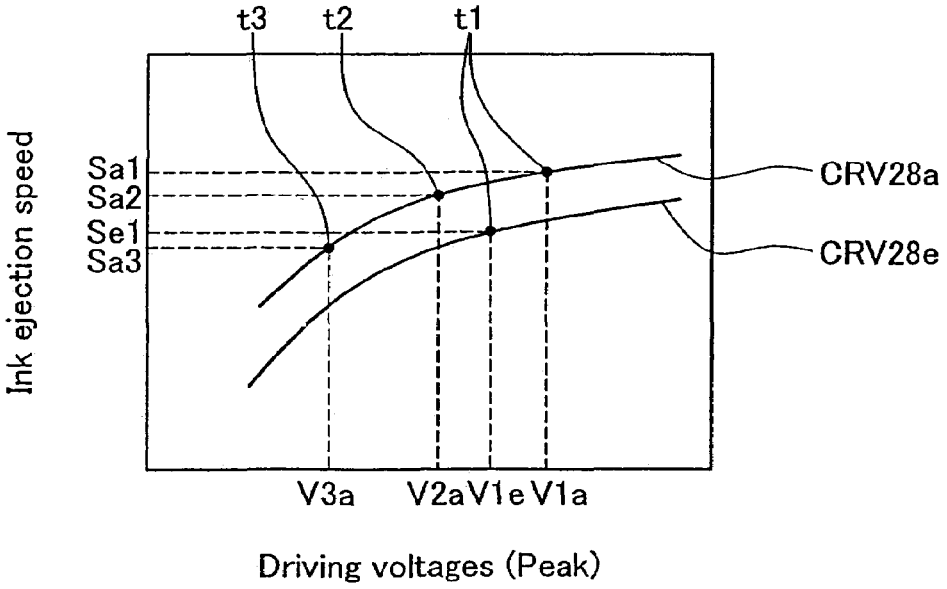
FIGS. 10A and 10B are explanatory views showing a difference in ink ejection speed between the print heads 28*a* and 28*e*, when the print head 28*a* is located at a higher position than the print head 28*e*.

FIGS. 10A and 10B are explanatory views showing a difference in ink ejection speed between the print heads 28*a* and 28*e*, when the print head 28*a* is located at a higher position than the print head 28*e*. In this example, since the print head 28*a* is located at a higher position than the print head 28*e* as shown in FIG. 3, the temperature of the print head 28*a* tends to be higher than the temperature of the print head 28*e* in the course of printing. Combinations shown in FIG. 10A are thus expected with regard to the temperatures of the print heads 28*a* and 28*e*.

As clearly understood from the graph of FIG. 9, the ink ejection speed of the print head 28*a* is higher than the ink ejection speed of the print head 28*e*. Namely the print head having a relatively high ink ejection speed is located at the position having a relatively large temperature variation in this example.

FIG. 10B is an explanatory view showing a difference in ink ejection speed between the print heads 28*a* and 28*e* at the temperatures assumed in the layout of this example. This graph is extraction of part of the plots from the graph of FIG. 9. As shown in FIG. 10B, in this example, while the temperature of the print head 28*e* remains in the temperature zone Z1 shown in FIG. 8, the temperature of the print head 28*a* is shifted from the temperature zone Z1 to the temperature zone Z3.

As clearly understood from the graph of FIG. 10B, the ink ejection speed of the print head 28*a* located at the position having a relatively large temperature variation decreases with a temperature increase, because of the accompanied variation of the driving signal. The ink ejection speed of the print head 28*a* is, on the other hand, higher than the ink ejection speed of the print head 28*e* at a fixed temperature. The difference in ink ejection speed between the print heads 28*a* and 28*e* is thus diminished, as the driving signal varies to compensate for the quantity of ink ejection. The variation of the driving signal to compensate for the quantity of ink ejection is similar to that discussed in the first embodiment.

Figures 11A, 11B:
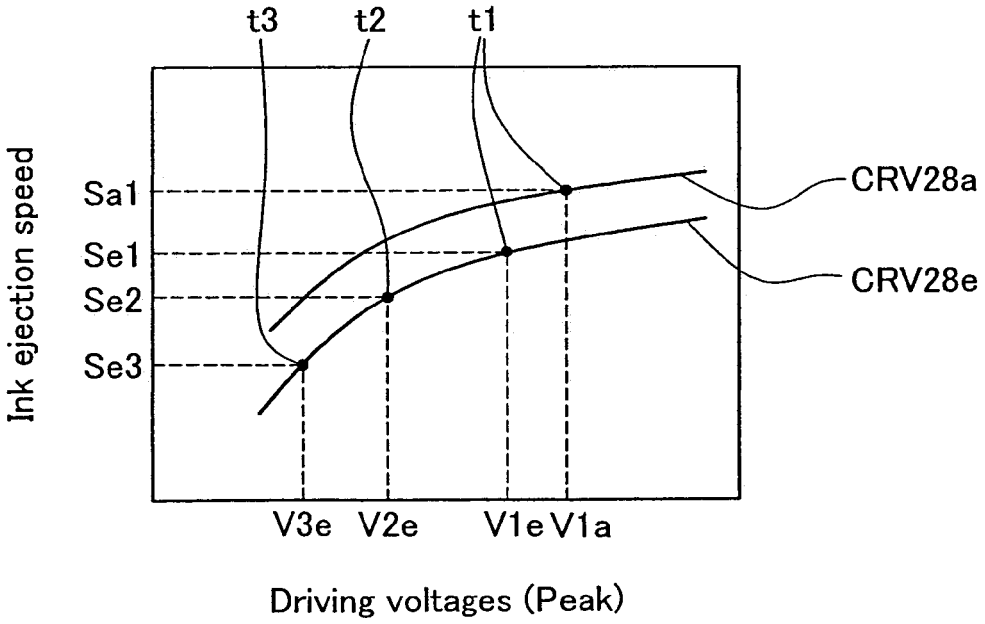
FIGS. 11A and 11B are explanatory views showing a difference in ink ejection speed between the print heads 28*a* and 28*e*, when the print head 28*a* is located at a lower position than the print head 28*e*.

FIGS. 11A and 11B are explanatory views showing a difference in ink ejection speed between the print heads 28*a* and 28*e*, when the print head 28*a* is located at a lower position than the print head 28*e*. The layout of the print heads in this example is reverse to that in the example of FIGS. 10A and 10B. Combinations shown in FIG. 11A are thus expected with regard to the temperatures of the print heads 28*a* and 28*e*. Contrary to the example of FIGS. 10A and 10B, the print head having a relatively low ink ejection speed is located at the position having a relatively large temperature variation in this example.

As shown in the graph of FIG. 11B, in this example, the relatively low ink ejection speed of the print head 28*e* further decreases with a temperature increase. The technique of compensating for the quantity of ink ejection thus expands the difference in ink ejection speed between the print heads 28*a* and 28*e*.

As described above, the print head having a higher ink ejection speed in the case of ejecting an ink drop of a fixed weight at a fixed temperature is located at the position having a relatively large temperature variation (that is, at a higher position). The technique of compensating for the quantity of ink ejection due to the temperature variation among the print heads thus simultaneously prevents the variation of the ink ejection speed. This results in desirably reducing a variation in hitting position of ink dots and thus further improves the printing quality.

In the structure of the second embodiment, the print head having a higher ink ejection speed is located at the position having a relatively large temperature variation. The layout of the print heads may be determined by regarding the print head having a relatively high driving voltage for ejecting an ink drop of a fixed weight at a fixed temperature as the print head having a higher ink ejection speed. The ink ejection speed and the driving voltage generally have a positive correlation. The advantage of this arrangement allows for easy application of the invention without requiring measurement of the ink ejection speed.

In the structure of the second embodiment, the print head having a higher ink ejection speed is located at the position having a relatively large temperature variation. In the case where multiple print heads are located at multiple positions of different elevations in the operation of a printing apparatus, the layout of the print heads may be determined by regarding a relatively high position as the position having a relatively large temperature variation. This is because the relatively high position has a larger temperature variation.

In this case, the layout of the print heads is determined, such that the print head having a higher driving voltage (peak voltage), for example, at the reference temperature t1 is located at a higher position.

D. Modifications

The above embodiments and applications are to be considered in all aspects as illustrative and not restrictive. There may be many modifications, changes, and alterations without departing from the scope or spirit of the main characteristics of the present invention. Some examples of possible modification are given below.

D-1. In the embodiments discussed above, the multiple print heads are located at multiple positions of different elevations in the operation of the printing apparatus. All the print heads may alternatively be located at an identical elevation. The technique of the present invention, however, has significant effects on the former structure, since the temperature of the print head located at a higher position tends to be higher than the temperature of the print head located at a lower position.

D-2. In the embodiments discussed above, plural (for example, 5) temperature sensors are used for multiple (for example, 20) print heads. This number of temperature sensors is, however, not restrictive, and only one temperature sensor may be used. The general requirement of the invention is that the number of temperature sensors is less than the number of print heads. It is not necessary to attach the temperature sensor directly to the print head. The temperature sensor is to be located sufficiently close to the print head to allow for measurement of the temperature of the print head.

When only one temperature sensor is used, it is preferable that the temperature sensor is disposed on the print head having a largest possible temperature variation. The print head having a largest possible temperature variation is the print head located at the highest position, in the case where the multiple print heads are located at multiple positions of different elevations in the operation of the printing apparatus.

D-3. In the embodiments discussed above, the original drive waveform generator selects one among the driving waveforms having different peak voltages, corresponding to the temperature of the print head. One modified arrangement may continuously adjust the shape of the driving waveform according to the temperature of the print head. Another modified arrangement may regulate the width in the time direction as well as the amplitude of the driving waveform.

In the embodiments discussed above, the driving waveform is set for each print head. One possible modification may set only the original drive waveform to be supplied to part of the print heads having larger temperature variations, while fixing the original drive waveform supplied to the other print heads. In general, the original drive waveform generator of the present invention is required to set the original drive waveform supplied to at least part of the multiple print heads, according to the output of the temperature sensors.

D-4. In the embodiments discussed above, the original drive waveform supplied to at least part of the multiple print heads is determined according to the output of the temperature sensors. One possible modification incorporates a circuit of raising a resistance with a temperature rise in the print head to reduce a variation in quantity of ink ejection with the temperature rise.

In the embodiments discussed above, ejection of ink drops is controlled to compensate for the variation in ejection of ink drops due to the temperature variation among the multiple print heads. The ejection controller may be constructed to stop ejection of ink drops according to the output of the temperature sensors.

The ejection controller may be designed, for example, to cease ejection of ink drops, for example, when a preset or greater number of temperature sensors among the plural temperature sensors detect the temperature exceeding a preset level. This arrangement effectively prevents any significant deterioration of the printing quality due to the temperature variation among the print heads, and desirably protects the printing apparatus from the severe hot environment.

The printing apparatus is preferably constructed to stop not only ejection of ink drops but all the printing processes in such circumstances. Another preferable arrangement of the printing apparatus is to output an alarm signal when a given or greater number of temperature sensors among the plural temperature sensors detect the temperature exceeding a specific level, which is lower than the preset level.

In general, the ejection controller of the invention is constructed to control ejection of ink drops from at least part of the multiple print heads according to the output of the temperature sensors. The technique of setting the original drive waveform as discussed above, however, advantageously attains the finer control.

D-5. In the embodiments discussed above, each print head has six nozzle arrays for ejecting six different color inks. Each print head may alternatively have a single nozzle array for ejecting one identical color ink. The print head of the invention is generally required to have a nozzle array including multiple nozzles for ejecting at least one identical color ink.

In the case where each print head has multiple nozzle arrays, it is desirable that the respective nozzle arrays have similar properties. For example, when each print head has three nozzle arrays for ejecting three different color inks, cyan, magenta, and yellow, the three nozzle arrays are preferably designed to restrict a variation in driving voltage for ejecting an ink drop of a fixed weight within a preset allowable range.

D-6. The technique of the invention is applicable to a printing apparatus that has plural print modes of different printing resolutions and is capable of selecting one among the plural print modes to carry out printing. In this structure, it is preferable to control the ejection of ink drops from the multiple print heads according to both the output of the temperature sensors and the selected print mode, in place of the output of the temperature sensors alone.

D-7. The technique of the invention is not restricted to color printing but is also applicable to monochrome printing. The invention may also be applied to a printing system that forms multiple dots in each pixel to express multiple tones, as well as to drum printers. In the drum printers, a drum rotating direction and a carriage moving direction respectively correspond to the main scan direction and the sub-scan direction. The technique of the invention is not limited to ink jet printers but is applicable in general to dot recording apparatuses that record dots on the surface of a printing medium with a record head having multiple nozzle arrays.

D-8. In the embodiments discussed above, part of the construction actualized by the hardware may be replaced by software. On the contrary, part of the configuration actualized by the software may be replaced by the hardware. For example, part or all of the functions of the printer driver 96 shown in FIG. 1 may be executed by the control circuit 40 in the printer 20. In this case, part or all of the functions of the computer 90 as the print control apparatus of generating print data are executed by the control circuit 40 of the printer.

When part or all of the functions of the invention are actualized by the software configuration, the software may be provided in the form of storage in a computer readable recording medium. In the description of the present invention, the 'computer readable recording medium' is not restricted to portable recording media, such as flexible disks and CD-ROMs, but includes internal storage devices of the computer like various RAMs and ROMs as well as external storage devices fixed to the computer like hard disks.

What is claimed is:

1. A printing apparatus for printing by ejecting ink drops onto a print medium, the printing apparatus comprising:

N print heads, wherein each of the N print heads ejects a plurality of colors of ink, wherein each of the N print heads comprises a plurality of nozzles associated with each of the plurality of colors of ink ejected by the print head, and wherein N is an integer of at least two;

M temperature sensors, M being an integer of at least one; and an ejection controller which controls the ejection of the ink drops from at least one of the N print heads in response to an output of the M temperature sensors, wherein the integer M is smaller than the integer N wherein the N print heads are located at a plurality of positions of different elevations in the printing apparatus; and wherein the M temperature sensors are disposed at at least one of the plurality of positions of different elevations.

2. The printing apparatus in accordance with claim 1, wherein at least one of the M temperature sensors is disposed at a highest position among the plurality of positions of different elevations.

3. A method of printing by ejecting ink drops onto a print medium, the method comprising the steps of:

(a) providing:

N print heads, wherein each of the N print heads ejects a plurality of colors of ink, wherein each of the N print heads comprises a plurality of nozzles associated with each of the plurality of colors of ink ejected by the print head, and wherein N is an integer of at least two; and M temperature sensors, M being an integer of at least one; and (b) controlling the ejection of the ink drops from at least one of the N print heads in response to an output of the M temperature sensors, wherein the integer M is smaller than the integer N, wherein the plurality of colors of ink ejected from each of the N print heads is every color of ink available in the printing apparatus;

wherein the N print heads are located at a plurality of positions of different elevations; and wherein the M temperature sensors are located at at least one of the plurality of positions of different elevations.

4. The method in accordance with claim 3, wherein at least one of the M temperature sensors is located at a highest position among the plurality of positions of different elevations.

* * * * *